United States Patent [19]

Eschenbach et al.

[11] 3,983,720

[45] Oct. 5, 1976

[54] CIRCULAR KNITTING SLIT FABRIC GUIDE

[75] Inventors: Paul W. Eschenbach, Inman; Herbert Ray King, Spartanburg, both of S.C.

[73] Assignee: Deering Milliken Research Corporation, Spartanburg, S.C.

[22] Filed: May 5, 1975

[21] Appl. No.: 574,594

[52] U.S. Cl. ..... 66/147; 66/151; 26/82

[51] Int. Cl.[2] ..... D04B 35/00

[58] Field of Search ..... 26/55 R, 55 C, 82; 66/147, 151

[56] References Cited

UNITED STATES PATENTS

| | | | |
|---|---|---|---|
| 2,037,282 | 4/1936 | Stafford et al. | 66/151 |
| 2,798,515 | 7/1957 | York | 26/55 R X |
| 3,218,829 | 11/1965 | Seiler | 66/147 |

FOREIGN PATENTS OR APPLICATIONS

| | | | |
|---|---|---|---|
| 279,190 | 10/1913 | Germany | 26/55 R |
| 1,269,088 | 5/1968 | Germany | 26/55 R |
| 1,061,189 | 3/1967 | United Kingdom | 26/55 C |

*Primary Examiner*—Mervin Stein
*Assistant Examiner*—A. M. Falik
*Attorney, Agent, or Firm*—Earle R. Marden; H. W. Petry

[57] ABSTRACT

An improved circular knitting machine which provides for semiautomatic doffing of large diameter rolls of knit fabric. The doffing of the fabric can be accomplished by a woman operator without strain. The knitting machine has a unique spreader bar to allow slitting of the fabric for inspection purposes while the fabric is being knit. The unique spreader bar includes a support member having a wheel member and a convex portion adjacent the wheel member to guide a fabric around the wheel.

2 Claims, 13 Drawing Figures

CIRCULAR KNITTING SLIT FABRIC GUIDE

It is an object of the invention to provide a more efficient circular knitting machine which will allow the production of large rolls of fabric which can be more readily doffed from the knitting machine.

Other objects and advantages of the invention will become clearly apparent as the specification proceeds to describe the invention with reference to the accompanying drawings, in which.

Figure 1:
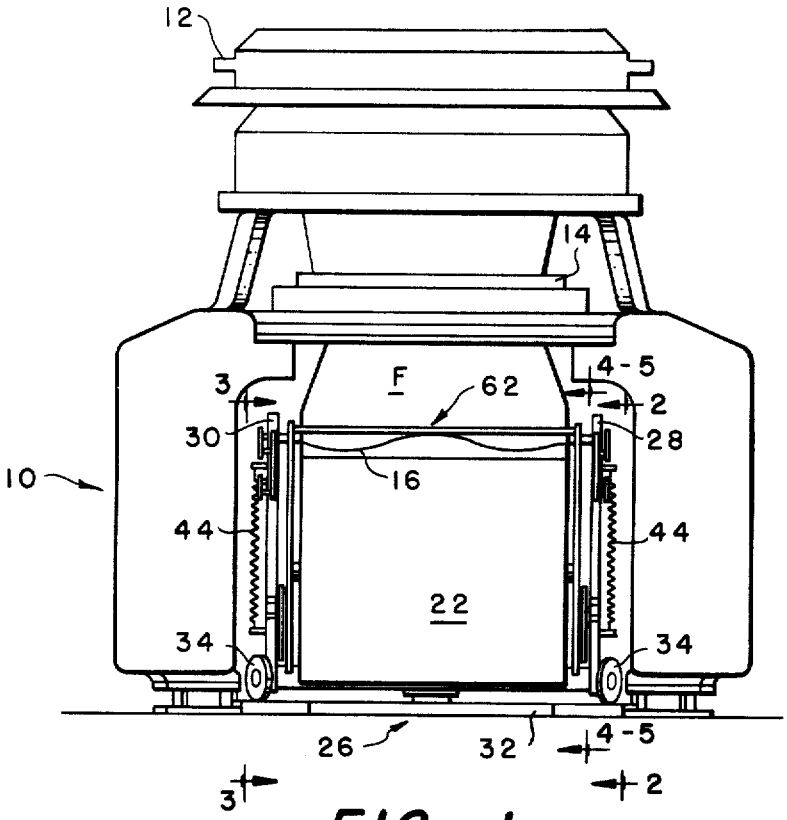
FIG. 1 is a front elevation partially schematic view of a circular knitting machine incorporating the novel doffing apparatus.
Figure 6:
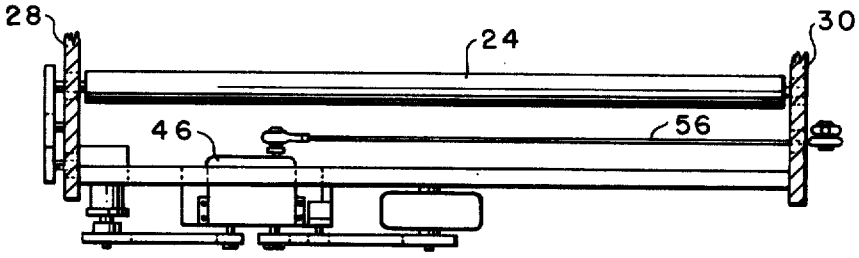
FIG. 6 is a top section view taken on line 6—6 of FIG. 3.
Figure 2:
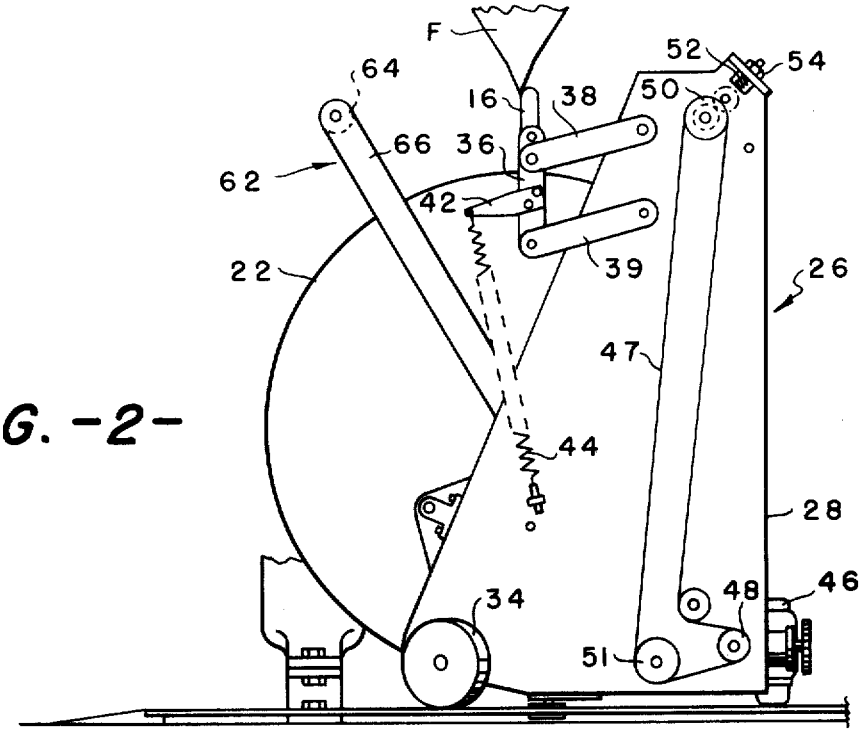
FIG. 2 is a view taken on line 2—2 of FIG. 1 showing one side of the take-down and take-up arrangement.
Figure 3:
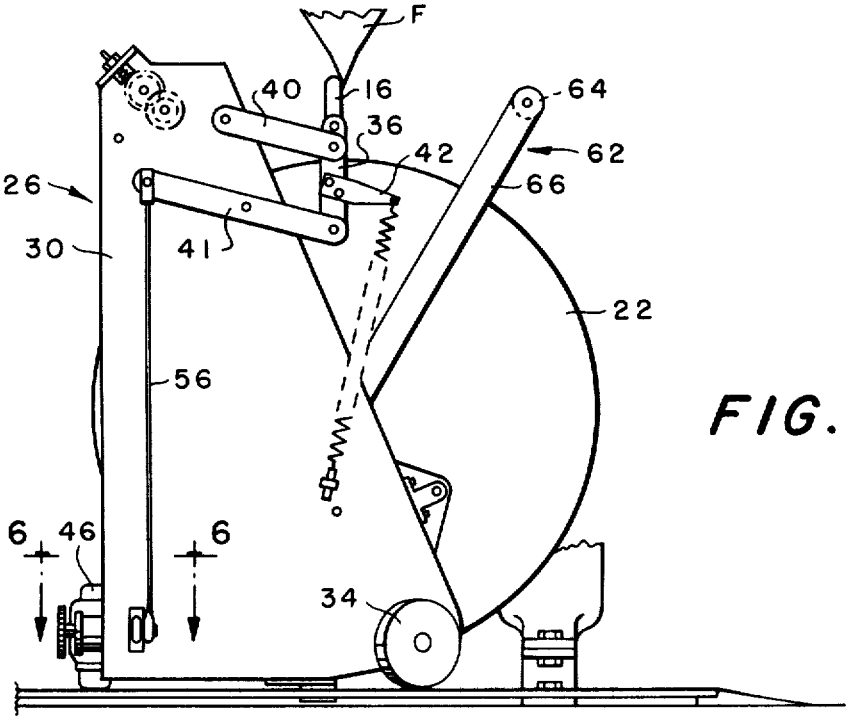
FIG. 3 is a view taken on line 3—3 of FIG. 1 showing the other side of the take-down and take-up apparatus.

Looking now to FIG. 1 there is shown a conventional double knit circular knitting machine 10 supplied with a plurality of yarns from an off-side creel (not shown). The yarn is supplied through the yarn guide ring 12 to the rotating needle cylinder 14 whereat it is knit into a tube of fabric F. The fabric F from the needle cylinder 14 passes downwardly over a conventional spreader bar 15 to spread it into a flat shape and then passes under the oxbow shaped rod 16 and over the secondary spreader bar 17 to the driven take-down rolls 18 and 20 which are off-set rearwardly from the centerline of the knitting machine. From the take-down rolls 18 and 20 the flattened fabric F is delivered to the take-up roll 22 which is driven by surface drive roll 24 which is also off-set rearwardly from the centerline of the knitting machine.

The fabric take-down structure, generally designated 26 and shown in detail in FIGS. 2–6, is supported by the upright frame members 28 and 30 and rotates on track 32 in synchronism with the rotation of the needle cylinder 14 via wheels 34 rotatably connected to the frame members 28 and 30.

The oxbow shaped rod 16 is suspended for vertical movement by arms 36 which are pivotally secured to lever arms 38, 39, 40 and 41 pivotally mounted to the frame members 28 and 30 substantially parallel to one another. To bias the rod 16 in the downward position another lever arm 42 is fixed to each of the arms 36 and has a spring member 44 connected thereto with the other end of the spring being connected to each of the frame members 28 and 30.

As described briefly above, the rod 16 is oxbow shaped and is located between the needle cylinder 14 and the take-down rolls 18 and 20 so that the fabric F passes under the rod 16 as it passes to the take-down rolls 18 and 20. For the most sufficient operation of the machine it is desired to maintain the tension between needle cylinder 14 and the take-down rolls 18 and 20 substantially the same across the width of the fabric F.

Since the fabric length adjacent the center of the fabric F is longer than the fabric length adjacent the ends of the fabric when the cylinder of knit fabric at the cylinder needles 14 is spread and flattened under the same theoretical tension, it is necessary to decrease the length of travel of the center of the flattened fabric F between the needle cylinder 14 and the take-down rolls 18 and 20 relative to the path of travel of the flattened fabric outward of the center of the fabric to maintain a constant tension across the width of the fabric since the take-down rolls apply a substantially even pull across the width of the flattened fabric F. Therefore, the rod 16 is oxbow shaped to decrease the path of travel of the fabric at the center of the rod and increase the path of travel of the fabric slightly outward of the center of the fabric to compensate for the differential fabric lengths developed when the cylinder or tube of fabric is spread and flattened prior to delivery to the take-down rolls 18 and 20. As noted briefly before, a secondary spreader bar 17 is located inside the flattened fabric tube F to control the width of the tube. The secondary spreader bar 17 has a pair of wheels 82 and 84 pivotally mounted on each end thereof to roll inside the fabric as the fabric is drawn by the take-down rolls 18 and 20. Bar 17 basically consists of two threaded portions 86 and 88 with a turnbuckle 90 mounted therebetween to vary the width of the fabric F. The spreader bar 17 is secured to the spreader bar 15 by means of cables 92 which pass under the oxbow shaped rod 16 inside the fabric.

As discussed briefly, the needle cylinder 14 and the take-down apparatus 26 are rotated in synchronism by a drive means (not shown). The take-down rolls 18 and 20 and the surface drive roll 24 are driven by a separate variable speed drive motor 46 mounted on the take-down unit. The drive motor 46 drives both the roll 20 and 24 through a suitable drive belt 47 connected to the sprocket 48 operably associated with the shaft of the drive motor, the sprocket 50 on the shaft of take-down roll 20 and the sprocket 51 on the shaft of the surface drive roll 24. To maintain nip pressure between rolls 18 and 20, the roll 18 is spring located by means of a spring 52 toward the roll 20 and can be adjusted by adjustment of the nut 54. When the nip pressure between the take-down rolls 18 and 20 has been adjusted the speeds of the take-down rolls 18 and 20 and the surface roll are automatically and simultaneously adjusted in accordance with the pull down tension in the fabric F by the vertical position of the rod 16. The vertical position of the rod 16 through the arm 36 and the lever 41 controls the vertical position the rod 56 connected to the lever 41 which in turn adjusts the speed of the variable speed motor 46.

As noted above, the take-down rolls 18 and 20 are off-set from the centerline of the machine toward the rear thereof to allow the production of a larger roll 22. When producing such a roll it is necessary to provide a means to readily doff same, especially when using female knitting machine operators. To this end the doffing mechanism consisting of a pair of lever arms 58, a pair of bell cranks 60, and a doffing handle mechanism 62 is employed. The doffing mechanism basically consists of a doffing handle 64 connected to a pair of elongated lever arms 66 each of which has a groove 68 therein facing toward the take-up roll 22. Each of the lever arms 58 is pivotally connected to one of the lever arms 66 at 70 and to the inner wall of the respective frame member 28 or 30 at 71. Each of the bell cranks 60 is also pivotally connected to one of the elongated lever arms 66 at 72 and to the inner wall of the respective frame member 28 or 30 at 74. Rigidly secured to each of the elongated lever arms 66 is a bracket member 67 which has a roll support rod 69 therebetween.

Figure 4:
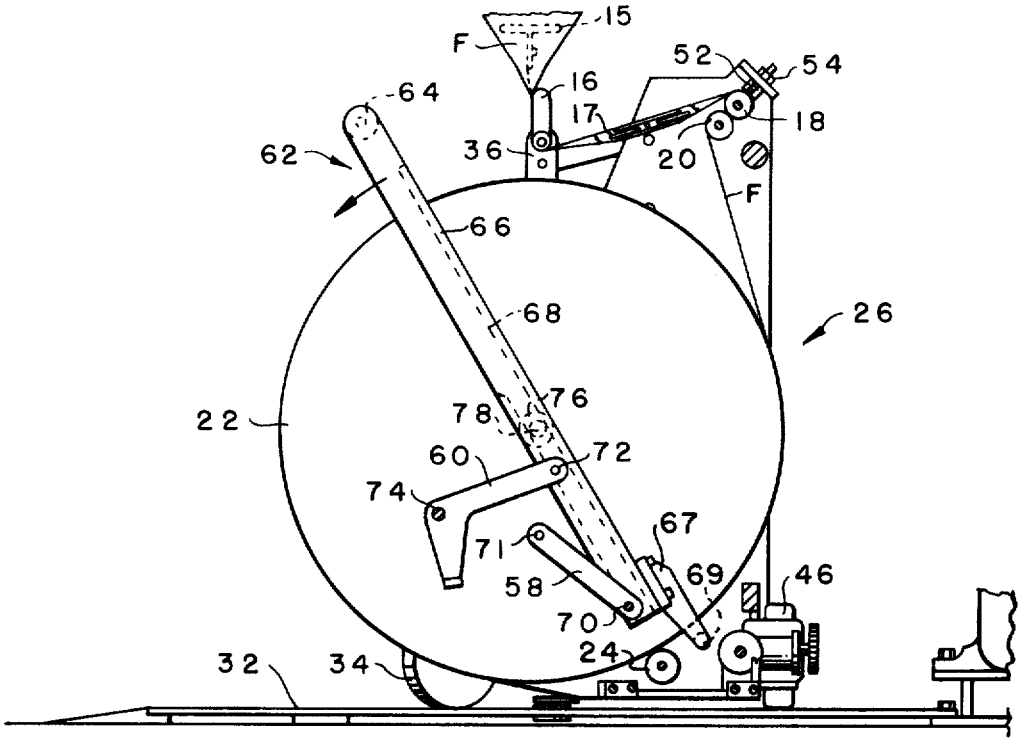
FIGS. 4 and 5 are views taken on line 45—45 of FIG. 1 showing the take-up roll partially doffed (FIG. 4) and in the full doffing position (FIG. 5)
Figure 5:
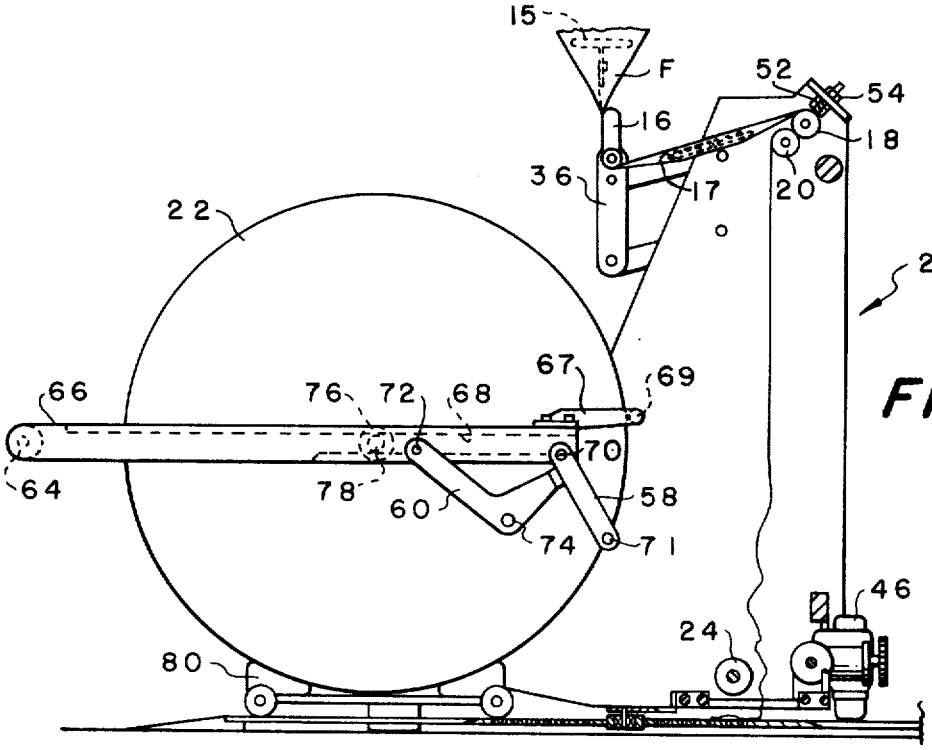
Figure 7:
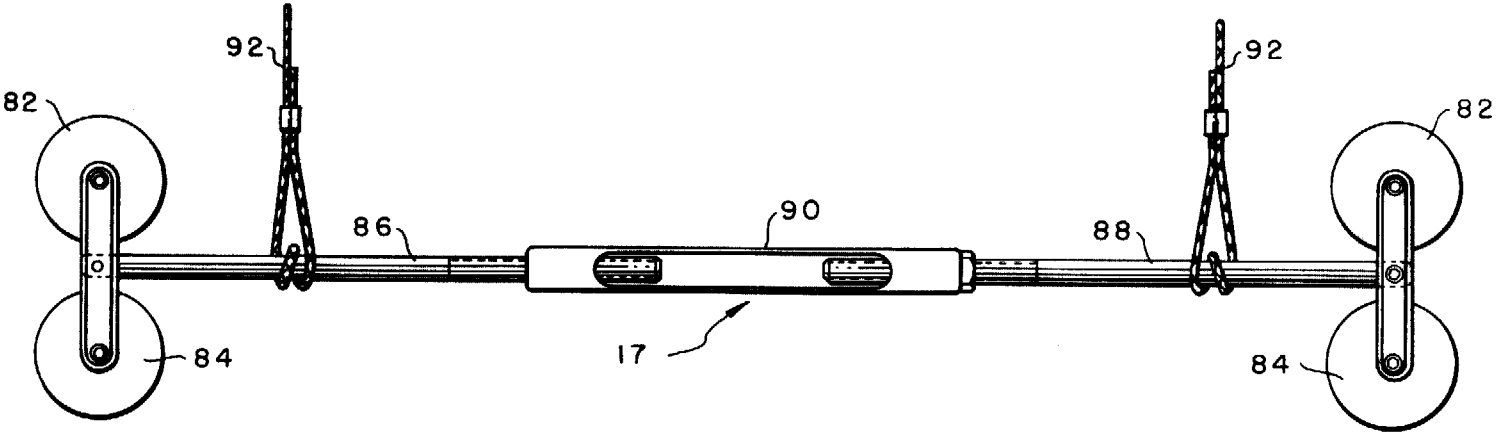
FIG. 7 is a top view of the secondary spreader bar.
Figure 8:
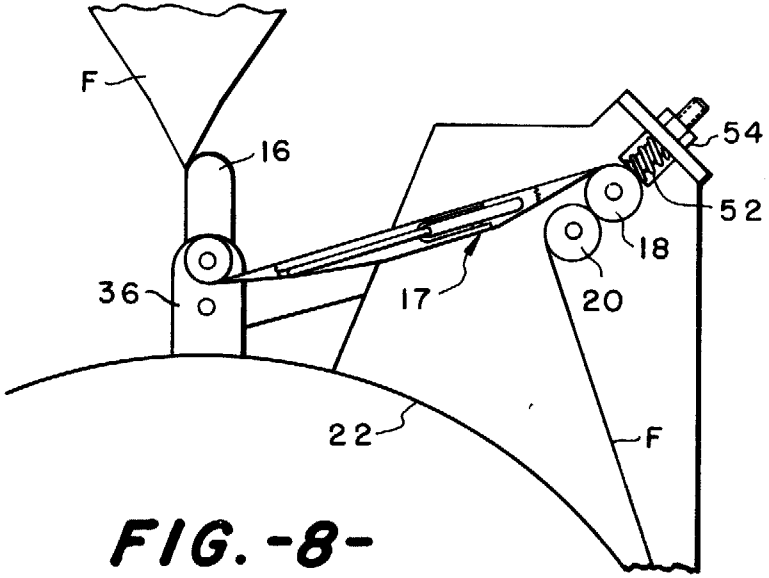
FIG. 8 is a partial view like FIGS. 4 and 5 showing an improved spreader bar.
Figure 9:
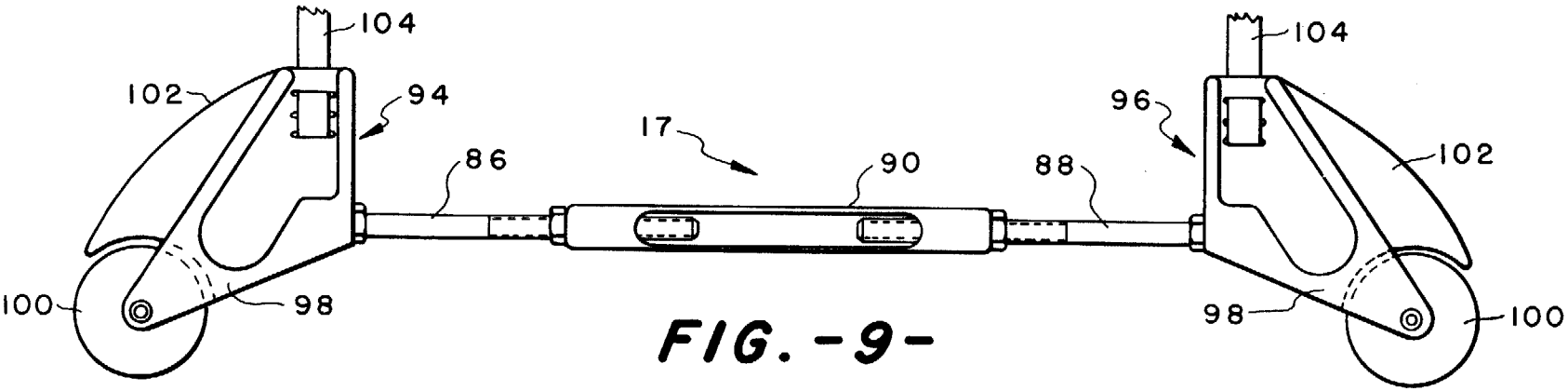
FIG. 9 is a view similar to FIG. 7 showing the improved spreader bar.
Figure 10:
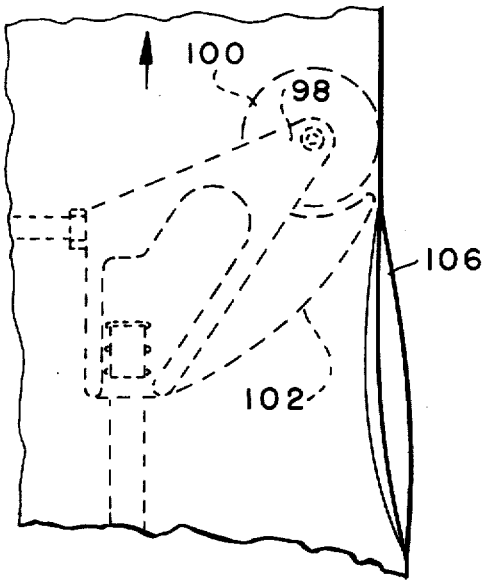
FIGS. 10–13 are progressive views of the action of the spreader bar as the knit fabric is being taken up.
Figure 11:
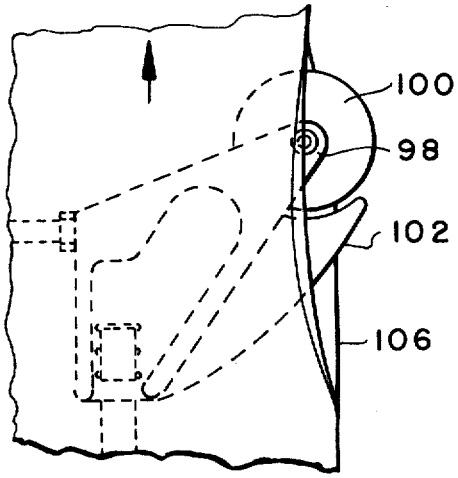
Figure 12:
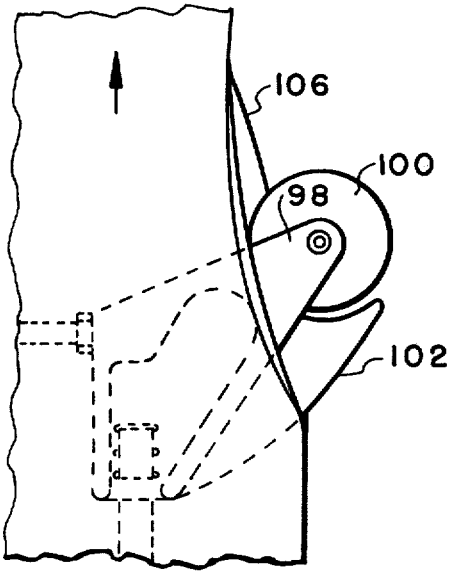
Figure 13:
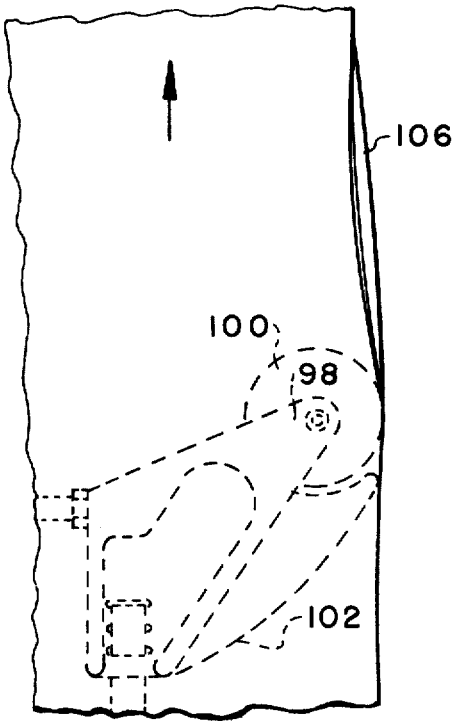

Looking now primarily to FIGS. 4 and 5 the doffing operation will be explained. As is well known the take-up roll winds up the fabric F on a tube 76 in which is inserted a core 78. As shown in FIGS. 4 and 5 the core 78 is slidably mounted in the groove 68 so that as the roll grows in diameter the core and tube will move upwardly. When the desired diameter roll is wound the doff handle 64 is grasped and moved in a counterclockwise direction to unroll the roll 22 somewhat to provide a fabric tail and to rotate the support 69 counterclockwise into engagement with the roll 22 to aid in causing the roll to be lowered onto the buggy 80. The core is guided by the links 58 and 60 to raise the center approximately 4'' before the roll is lowered toward the buggy 80. As the handle is being rotated to a horizontal position it is pulled to the left (FIGS. 4 and 5) to aid in depositing the roll 22 on the buggy 80. Then the doff handle is pushed to the right until the core 78 drops out of the groove 68 to disengage the roll 22. The core 78 is then disengaged from the tube 76, the fabric cut and the buggy moved to a remote position. Then the doffing mechanism is in position to be loaded with a new tube and be threaded up with more fabric.

As can readily be seen, the fabric F knit is a closed tubular shape and therefore it is difficult to inspect the fabric prior to take-up. To accomplish such inspection an operator will normally put an elongated slit in one side of the fabric F after it is knit and prior to take-up to allow an internal inspection of the fabric. It has been found that when this is done that the spreader bar 17 shown in FIGS. 1–7 tended to pop out of the slit and then as the fabric moved outward towards the rolls 18 and 20 the top of the slit caught on one of the rolls 82 or 84 and snarled and ripped the fabric. To eliminate this condition, the spreader bar 17 shown in FIGS. 8–13 has been adopted.

In FIGS. 8–13, like numerals refer to like parts of FIGS. 1–7. The main elongated bracing construction consisting of portions 86 and turnbuckle 90 are the same as in FIGS. 1–7. The main reconstruction consists of the support members 94 and 96 screwed or otherwise connected to the ends of the threaded members 86 and 88. Each of the support members has a pair of elongated pointed projections 98 integrally connected thereto which support a wheel 100 therebetween at the end thereof. The wheels 100 act in the same manner as the wheels 82 and 84 in FIGS. 1–7. Also, integrally connected to each member 94 and 96 is a convex portion 102 for reasons hereinafter explained. Similar to cables 92, the support members 94 and 96 are connected to the spreader bar 15 by means of cables or straps 104.

Looking now to FIGS. 10–13, the operation of the improved spreader bar is shown. As discussed above, a slit 106 is cut in the side of the fabric F above the spreader bar 17 so that the operator can physically look inside the fabric. Then as the fabric moves toward the rolls 18 and 20, as indicated by the arrows, it follows the sequence shown in FIGS. 10–13. When the fabric moves from the position shown in FIG. 10 to the position shown in FIG. 11 the particular support member 94 or 96 will pop out of the slit 106. Then as the fabric moves further to the position of FIG. 12 the top of the slit 106 will hit the curved surface 102 and tend to ride outwardly of the wheel 100. Then as the fabric moves further the fabric will move outside the wheel and then move further beyond the spreader bar 17. Once again, the spreader bar 17 will then be totally enclosed within the confines of the fabric tube.

It is obvious that an improved circular knitting machine has been provided that can roll up large rolls of knit fabric and which at the same time can be readily doffed with a minimum of effort.

Although the preferred embodiment of the invention has been described, it is contemplated that many changes may be made without departing from the scope or spirit of the invention and it is desired that the scope of the invention be limited only by the claims.

That which is claimed is:

1. A circular knitting machine comprising: a frame, a needle cylinder rotatably mounted in said frame, a take-up apparatus rotably mounted in said frame below said needle cylinder and a spreader bar mounted between said needle cylinder and said take-up apparatus, said spreader bar having a first elongated support member and a second support member mounted on each end of said first support member, said second support members each having a wheel means connected thereto and a portion thereof having a convex guiding means adjacent said wheel means to guide the trailing edge of a slit in a tubular knit fabric knit on said circular knitting machine outside the circumference of said wheel means.

2. The structure of claim 1 wherein each of said second support members includes a means to mount said spreader in position relative to said needle cylinder.

* * * * *